United States Patent [19]

Badcock

[11] Patent Number: 4,469,924

[45] Date of Patent: Sep. 4, 1984

[54] PORTABLE ELECTRIC POWER TOOLS

[75] Inventor: David N. W. Badcock, London, England

[73] Assignee: Kango Wolf Power Tools Limited, London, England

[21] Appl. No.: 341,153

[22] Filed: Jan. 19, 1982

[30] Foreign Application Priority Data

Jan. 19, 1981 [GB] United Kingdom ..... 8101502

[51] Int. Cl.[3] ..... H01H 9/06

[52] U.S. Cl. ..... 200/157; 200/297

[58] Field of Search ..... 339/147; 200/157, 297, 200/51 R; 361/347, 350, 353

[56] References Cited

U.S. PATENT DOCUMENTS

| | | | |
|---|---|---|---|
| 3,278,963 | 10/1966 | Bond | 200/157 |
| 3,766,352 | 10/1973 | Bigley et al. | 200/157 X |
| 3,882,294 | 5/1975 | Hults | 200/157 |
| 4,097,704 | 6/1978 | Piber | 200/157 |
| 4,118,615 | 10/1978 | Leibundgut | 200/157 |
| 4,295,018 | 10/1981 | Borrelli | 200/297 |
| 4,329,006 | 5/1982 | Gale | 339/147 R X |

*Primary Examiner*—John W. Sheppard
*Assistant Examiner*—Renee S. Kidorf
*Attorney, Agent, or Firm*—Wenderoth, Lind & Ponack

[57] ABSTRACT

A portable electric power tool incorporates in conjunction with its double-pole main switch mechanism (11) a separate carrier member (10) which carries two pairs of terminals (20; 41) for the attachment of the main electric leads and the motor stator leads. Four pairs of complementary connectors (23, 24, 32, 33; 48) are also provided, the two connectors of each pair being mounted one on the carrier member (10) and the other on the switch mechanism (11) and the four connectors on the carrier member (10) are respectively connected to the terminals (20; 41). The carrier member (10) is appropriately located in the tool and has two posts (44) which become engaged in apertures (45) in the body of the switch mechanism (11) as the mechanism (11) is placed in position. The connectors (23, 24, 32, 33; 48) of each pair are so disposed that the act of positioning the switch mechanism (11) in this way brings the connectors (23, 24, 32, 33; 48) of each of the four pairs into engagement.

7 Claims, 2 Drawing Figures

PORTABLE ELECTRIC POWER TOOLS

BACKGROUND OF THE INVENTION

1. Field of the Invention

This invention relates to portable electric power tools.

2. Description of the Prior Art

The switches of such tools are subject to heavy wear and tear, and the conditions under which replacement switches are installed are commonly unsatisfactory. The replacement switches are also frequently fitted by persons lacking electrical skills. Switches currently used have numerous terminals, particularly where the switch is equipped with electrical interference suppression components, to which terminals the various electrical leads have to be connected, and in consequence of the lack of skills, the replacement switches are often not correctly fitted. The present invention is concerned with simplifying the fitting of the switches, both on the production line and on site.

SUMMARY OF THE INVENTION

According to this invention there is provided a portable electric power tool incorporating a double-pole main switch mechanism and having a handle portion, an operating element on the handle for operating the switch mechanism, a carrier member separate from the switch mechanism and carrying first terminals for the attachment thereto of electrical main supply leads, and second terminals to which the stator leads of the motor of the tool are connected. There are also four pairs of complementary connectors, the connectors of each pair being mounted one on the switch mechanism and the other on the carrier member. The four connectors on the carrier member are respectively electrically connected to the first and second terminals. There are also means for guiding the switch mechanism into an operative position relative to the carrier member. The connectors of each pair are so arranged that the four pairs of connectors are brought into engagement simply by moving the switch mechanism into the operative position.

According to a preferred feature of the invention, the four pairs of connectors are adapted and arranged when engaged to be capable of holding the carrier member and switch mechanism resiliently together.

According to another preferred feature of the invention, the carrier member further carries electrical interference suppression components connected in circuit with the second terminals.

BRIEF DESCRIPTION OF THE DRAWINGS

One embodiment of the invention wll now be described by way of example with reference to the accompanying drawings in which.

DETAILED DESCRIPTION OF THE PREFERRED EMBODIMENT

Figure 1:
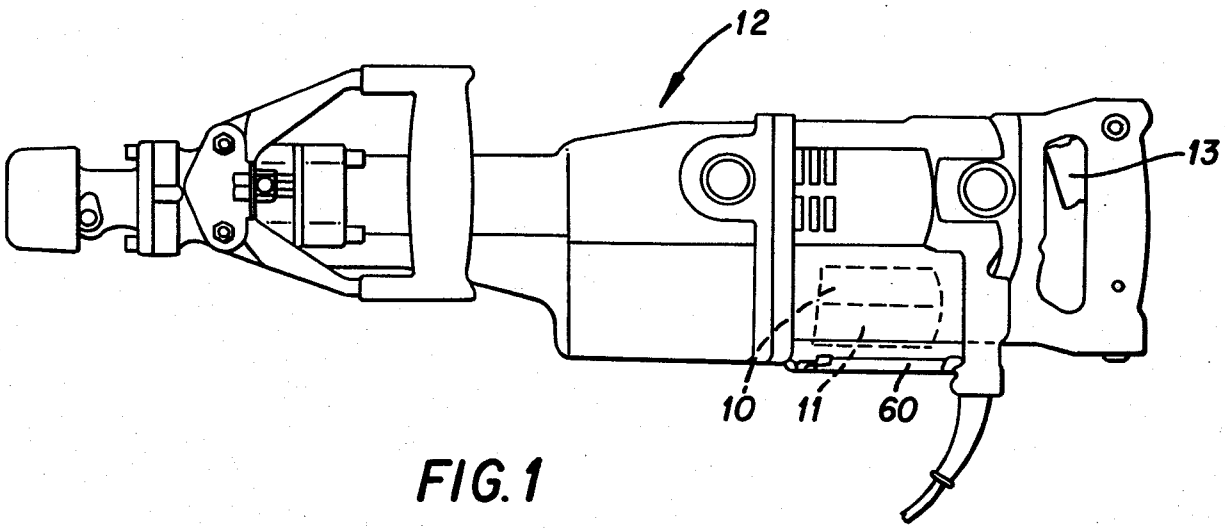
FIG. 1 shows a portable electric power tool incorporating the invention.
Figure 2:
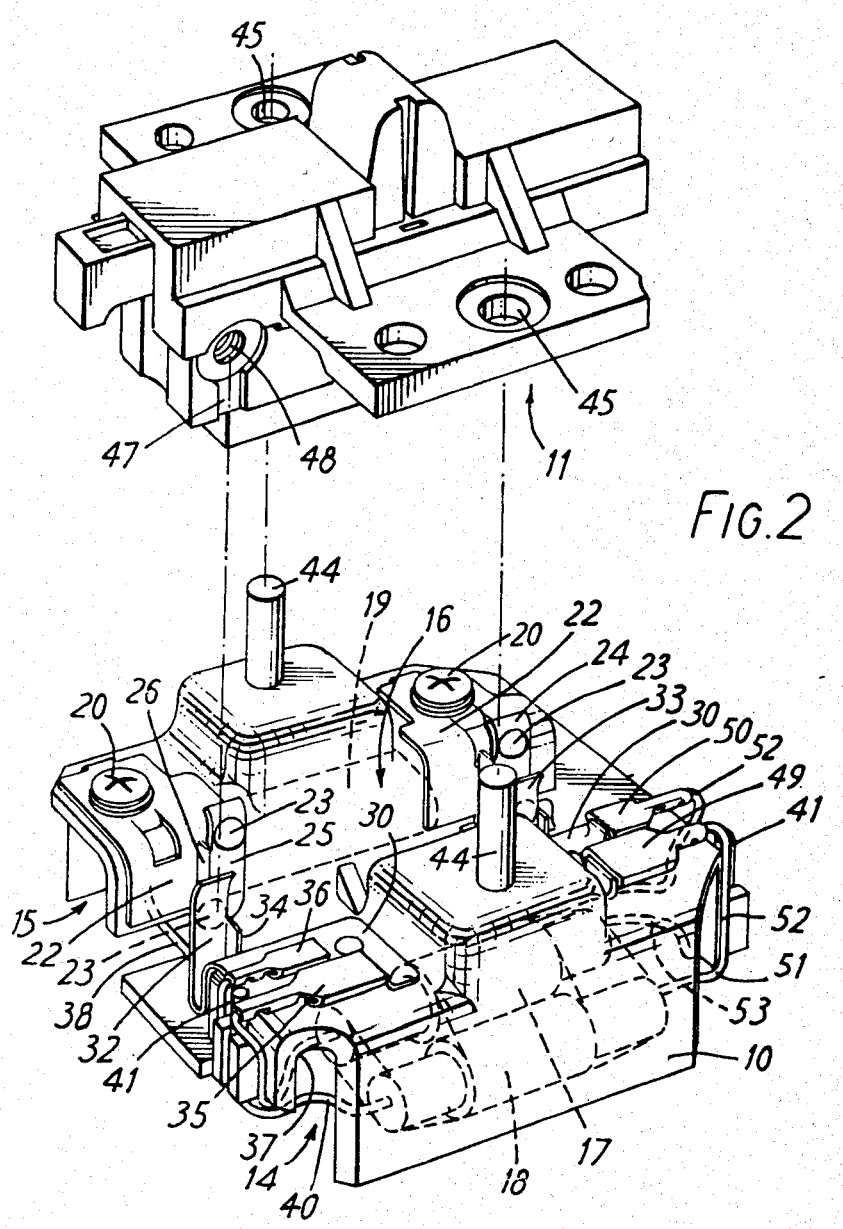
FIG. 2 shows the switch mechanism and carrier member of power tool of FIG. 1 according to the invention.

Referring to the drawings, a plastic carrier member 10 and an on/off switch mechanism 11 for the electric drive motor of the tool 12 (which in this embodiment is an electric hammer) are designed to fit snugly in a recess provided for the purpose in a plastic handle moulding (not shown) of the tool 12. The switch mechanism 11 is in this instance actuated by a trigger 13 on the handle of the tool 12.

The carrier member 10 is in the form of a shell and provides two downwardly facing recesses 14, 15 on its underside and an intermediate upwardly facing recess 16 on its upper side. In the arrangement shown two inductors 17, 18 are disposed in recess 14 and a capacitor 19 is disposed in recess 15, these components being connected in circuit with the motor input for the suppression of electrical interference. Two screw-type terminals 20 are mounted on the carrier member 10 for connection with the electrical supply leads, and two phosphor bronze contact plates 22 extend from the terminals 20 down the adjacent side wall of recess 16 and have their ends upturned and dimpled to provide a domed projection 23 on one face. The connectors 24, 25 formed by the upturned ends are thus in the form of a springy leaf. A small lug 26 is formed on each leaf to limit the displacement of each connector 24, 25 towards the main body of the respective contact plates 22.

Two further phosphor bronze contact plates 30 are riveted to the carrier 10 and have portions which extend down the other side wall of recess 16 and have their end part up-turned to form leaf spring connectors 32, 33 having a dimple on one face to provide a domed projection 23 on the other face. A lug 34 on each leaf limits the displacement of the leaf towards the main body of the contact plate 30. Each of these contact plates 30 has two projecting blades to which contact slide-clips 35, 36 and 49, 50 are respectively attached. Clips 35, 36 and 49, 50 serve via conductors 37, 38 and 52, 53 to connect inductor 17 and capacitor 19 respectively across connectors 32, 33.

Two leads 40 and 51 from inductor 18 extend to respective terminal sockets 41 for bullet-type connectors (not shown) to which the stator leads of the motor are respectively connected. The terminal sockets 41 are housed in respective projections formed integrally with the carrier member 10.

The carrier member 10 also has two upstanding posts 44 formed integrally therewith. These posts 44 are engaged with respective apertures 45 in the housing of the switch mechanism 11 to guide and locate the switch mechanism 11 during connection of the latter to the carrier member 10.

It will be understood that the carrier member 10 and the components it carries as shown form a convenient sub-assembly which requires only the stator leads plugged into terminal sockets 41 and the main conductors connected to terminals 20 to make it ready for securing in the previously mentioned recess in the handle moulding (not shown). The carrier member 10 is placed in the recess and the switch mechanism 11 is then connected to carrier member 10 by engaging the apertures 45 over posts 44 and pressing the switch mechanism 11 down thereover. The connectors 24, 25, 32, 33 engage in respective channels 47 in the housing of the switch mechanism 11 and their domed projections 23 engage firmly and resiliently in the outer ends of tubular metal contact inserts 48 as complementary connectors which are electrically connected to the switch contacts (not shown) inside switch mechanism 11. The connectors 24, 25 provide the input to the switch mechanism 11, and connectors 32, 33 carry the electrical output from the switch mechanism 11 to the stator (not shown).

The single act of pressing the switch mechanism 11 into place thus automatically makes all necessary electrical contacts. A cover plate 60, shown in FIG. 1 is then disposed over the switch mechanism 11 and is fastened over the recess, securing the switch mechanism 11 and sealing the recess against the ingress of dirt and moisture.

It will be understood that it is immaterial to the invention whether the switch mechanism 11 is of the toggle or trigger type. Furthermore the invention is applicable to existing portable electric power tools having, for example, switches provided with terminals which are designed to have the electric input leads connected to them directly.

Several advantages ensue from this construction. Since a substantial number of the necessary electrical components are mounted on the carrier member 10, a unit is obtained which, during its assembly, can be readily manipulated to facilitate the making of the various connections, and to which the motor stator leads are easily and rapidly connected on the main assembly line of the tools, thus giving increased speed of assembly and improved electrical safety.

Similarly, when servicing of the switch is required, replacement of the switch mechanism 11 and/or the carrier sub-assembly 10 can be carried out more quickly by and safely for the tool operator.

I claim:

1. A portable electric power tool comprising:

a double-pole main switch mechanism, a carrier member separate from the switch mechanism, first terminals mounted on the carrier member for the attachment thereto of electrical main supply leads, second terminals mounted on the carrier member to which the stator leads of the motor of the tool are connected, pairs of complementary connectors, the connectors of each pair being mounted one on the switch mechanism and the other on the carrier member, the connectors on the carrier member being respectively electrically connected to the first and second terminals, means for locating the switch mechanism in an operative position relative to the carrier member, the connectors of each pair being so arranged that the pairs of connectors are brought into engagement by a single act of pressing the switch mechanism into said operative position on the carrier member, whereby all necessary electrical contacts are automatically made, one connector of each pair including a resilient blade extending in the direction of the relative movement of the switch mechanism and the carrier member which brings the connectors of each pair into arrangement.

2. A power tool as claimed in claim 1, wherein the pairs of connectors are adapted and arranged when engaged to be capable of holding the carrier member and switch mechanisms resiliently together.

3. A power tool as claimed in claim 1 further comprising electrical interference suppression components mounted on the carrier member and connected in circuit with said second terminals.

4. A power tool as claimed in claim 1, wherein the locating means includes guide means comprising apertures and posts slidingly engaged in the apertures, each aperture and the post engaged therein being provided one on the carrier member and the other on the switch mechanism.

5. A portable electric power tool comprising:

a double-pole main switch mechanism;

a handle portion;

an operating element on the handle portion for operating the switch mechanism;

a carrier member separate from the switch mechanism;

first terminals mounted on the carrier member for the attachment of electrical main supply leads;

second terminals mounted on the carrier member to which the stator leads of the motor of the tool are connected;

four pairs of complementary connectors, the connectors of each pair being mounted one on the switch mechanism and the other on the carrier member, the four connectors on the carrier member being respectively electrically connected to the first and second terminals;

locating means for placing the switch mechanism in an operative position relative to the carrier member;

said connectors of each pair being so arranged that the four pairs of connectors are brought into engagement by moving the switch mechanism into said operative position;

said locating means including guide means having apertures and posts slidingly engaged in the apertures, each aperture and the post engaged therein being provided one on the carrier and the other on a housing portion of the switch mechanism;

one of the connectors of each pair including a resilient blade extending parallel to the posts and having a formation which comes into engagement with the other connector of the pair, said formation being operative to provide resilient location of the switch mechanism and the carrier member relative to each other in the direction of sliding movement permitted by the guide means.

6. A portable electric power tool comprising:

a double-pole main switch mechanism;

a handle portion;

means, arranged on the handle portion, for operating the switch mechanism;

a carrier member separate from the switch mechanism;

first terminals mounted on the carrier member for the attachment thereto of electrical main supply leads;

second terminals mounted on the carrier member to which the stator leads of the motor of the tool are connected;

four pairs of complementary connectors, the connectors of each pair being mounted one on the switch mechanism and the other on the carrier member, said four other connectors on the carrier member being respectively electrically connected to the first and second terminals;

locating means for placing the switch mechanism in an operative position relative to the carrier member;

said connectors of each pair being so arranged that the four pairs of connectors are brought into engagement by a single act of pressing the switch mechanism into said operative position on the carrier member, whereby all necessary electrical contacts are automatically made;

said locating means including guide means for bringing the connectors into engagement, said guide means having apertures and posts slidingly engaged in the apertures, each aperture and the post engaged therein being provided one on the carrier member and the other on a housing portion of the switch mechanism;

one of the connectors of each pair including a resilient blade extending parallel to the posts and having a formation which comes into engagement with the other connector of the pair, said formation being operative to hold the switch mechanism and the carrier member resiliently together relative to each other in the direction of relative sliding movement permitted by the guide means.

7. A power tool as claimed in claim 6, further comprising:

electrical interference suppression components mounted on the carrier member and connected in circuit with said second terminals.

* * * * *